US007022004B2

(12) United States Patent
Böhler

(10) Patent No.: US 7,022,004 B2
(45) Date of Patent: Apr. 4, 2006

(54) DEVICE FOR THE TREATMENT/WORKING OF SURFACES

(76) Inventor: Daniel Böhler, Waldkircher Str. 50, 79211 Denzlingen (DE)

( * ) Notice: Subject to any disclaimer, the term of this patent is extended or adjusted under 35 U.S.C. 154(b) by 137 days.

(21) Appl. No.: 10/389,291

(22) Filed: Mar. 14, 2003

(65) Prior Publication Data

US 2004/0082285 A1 Apr. 29, 2004

Related U.S. Application Data

(63) Continuation-in-part of application No. 10/338,418, filed on Jan. 8, 2003, now Pat. No. 6,848,984.

(30) Foreign Application Priority Data

Jan. 8, 2002 (DE) ..... 102 00 381
Jan. 27, 2003 (DE) ..... 103 03 082

(51) Int. Cl.
*B24B 23/00* (2006.01)

(52) U.S. Cl. ..... 451/366; 451/350; 451/353

(58) Field of Classification Search ..... 451/360, 451/350, 211, 272, 359, 344
See application file for complete search history.

(56) References Cited

U.S. PATENT DOCUMENTS 3,862,521 A * 1/1975 Isaksson ..... 451/456
4,033,077 A * 7/1977 Chester et al. ..... 451/360
5,263,283 A * 11/1993 Rudolf et al. ..... 451/344
5,407,381 A * 4/1995 Schaefer et al. ..... 451/358
5,637,032 A * 6/1997 Thysell et al. ..... 451/259
5,718,621 A * 2/1998 Turley ..... 451/342
6,248,007 B1 * 6/2001 deBlois et al. ..... 451/344
6,688,955 B1 * 2/2004 Ruey-Zon ..... 451/360
2004/0023608 A1 * 2/2004 Van Vliet et al. ..... 451/350
2004/0082285 A1 * 4/2004 Bohler ..... 451/359
2004/0132392 A1 * 7/2004 Bohler ..... 451/360

FOREIGN PATENT DOCUMENTS

DE 1 700 642 5/1955
DE 930 948 7/1955
EP 0 397 448 8/1990

* cited by examiner

*Primary Examiner*—Lee D. Wilson
(74) *Attorney, Agent, or Firm*—Welsh & Katz, Ltd.

(57) ABSTRACT

A device for the machining of surfaces comprises a first housing unit (1), at which the device is to be supported, and a second housing unit (2), in which at least one tool holding fixture (9) for the grinding tool respectively polishing tool is rotatable mounted. The first and the second housing unit (1, 2) are joined with one another relatively rotatable to each other. Furthermore the device comprises a driving unit to drive the at least one tool holding fixture (9) and to drive the second housing unit (2) for rotation relative to the first housing unit (1). As a result of the superposition of the rotation of the individual tool holding fixtures with the rotation of the housing units, in which the tool holding fixtures are mounted, arise a better and faster machining result, a good superposition of the grinding marks and thus a symmetrical grinding pattern.

13 Claims, 4 Drawing Sheets

DEVICE FOR THE TREATMENT/WORKING OF SURFACES

CROSS-REFERENCE TO RELATED APPLICATIONS

This application is a continuation-in-part of U.S. application Ser. No. 10/338,418, filed Jan. 8, 2003, now currently pending.

FIELD OF THE INVENTION

The invention relates to a device for the machining of surfaces in particular with a grinding or a polishing tool, whereby the device is designed in particular as motor driven handheld tool.

BACKGROUND OF THE INVENTION

Machines for working on surfaces by means of a driven grinding or polishing wheel are well known in different designs. These comprise for example so-called orbital sanders or eccentric sanders, with which a fixture for the actual tool, the sandpaper, is oscillated by means of an eccentric, which is rotated by a motor.

Furthermore also devices are already well known, with which several tool holding fixtures, for example in the form of discs for the mounting of grinding or polishing tools are intended, in order to cover a larger work area.

A particularly favorable device in regard to the grinding respectively polishing machining of also curved surfaces is described in DE 44 47 162 A. With this device three tool holding fixtures can be driven by a central motor and a set of gears in a triangular system for rotation around their own rotational axis, whereby the tool holding fixtures are mounted independently from each other swiveling in a ball joint-like fixture in a housing for the all-round horizontal swing of the rotational axis within a given angle range and the tool holding fixtures can be driven for rotation in each swiveling position.

A disadvantage of these existing grinding respectively polishing machines consists of the fact that the achievement of a symmetrical grinding pattern is only possible with relatively high experience, since the individual tools e.g. in the form of grinding or polishing discs of the machines machine during their rotation in each case only a certain partial surface and that for the machining of a larger connected surface the whole machine has to be moved manually by an operator over the surface to be machined. For this on the one hand an extensive symmetrical movement usually with large expenditure of force is required of the operator and on the other hand it is only possible with a high extent of experience and skill of the operator to hold the tool in symmetrical engagement and to avoid visible grinding marks or unevenness between the single working areas. Furthermore relative much time is necessary for the machining of a larger area, since the area that can be machined at the same time by such a device is limited to the sum of the single working on areas of the individual grinding or polishing discs of the machine.

Therefore it is the task of the invention to provide a device for the machining of surfaces that avoids the disadvantages described above or at least reduces them.

This task is solved by a device for the machining of surfaces in accordance with claim 1. Preferential embodiments are indicated in the sub claims.

As a result of the superposition of the rotation of the individual tool holding fixture(s) with the rotation of the housing unit, at respectively in which the tool holding fixture(s) is/are mounted, the device according to the invention enables an enlargement of the work area, a significantly better and faster machining result, and a good superposition of the grinding marks with the result of a very good and symmetrical grinding pattern with a noticeably reduced movement and without the necessity of high experience respectively skill of the operator.

Special benefits result from the application of the features according to the invention to the well-known grinding machine from DE 44 47 162 A, which possess one or several all-around swiveling rotatable tool holding fixtures. With this preferential embodiment the benefits specified above can be achieved during machining of even and curved surfaces.

Finally an expenditure of force for holding and guiding the device over the surface to be worked on is significantly reduced by neutralization of the torques, in particular with the direction of rotation moving in opposite directions of the tool holding fixture(s) on the one hand and the housing unit on the other hand.

BRIEF DESCRIPTION OF THE DRAWINGS

Following a preferential design example of the invention is described using the drawing. In the drawing are shown.

DETAILED DESCRIPTION OF THE INVENTION

Figure 1:
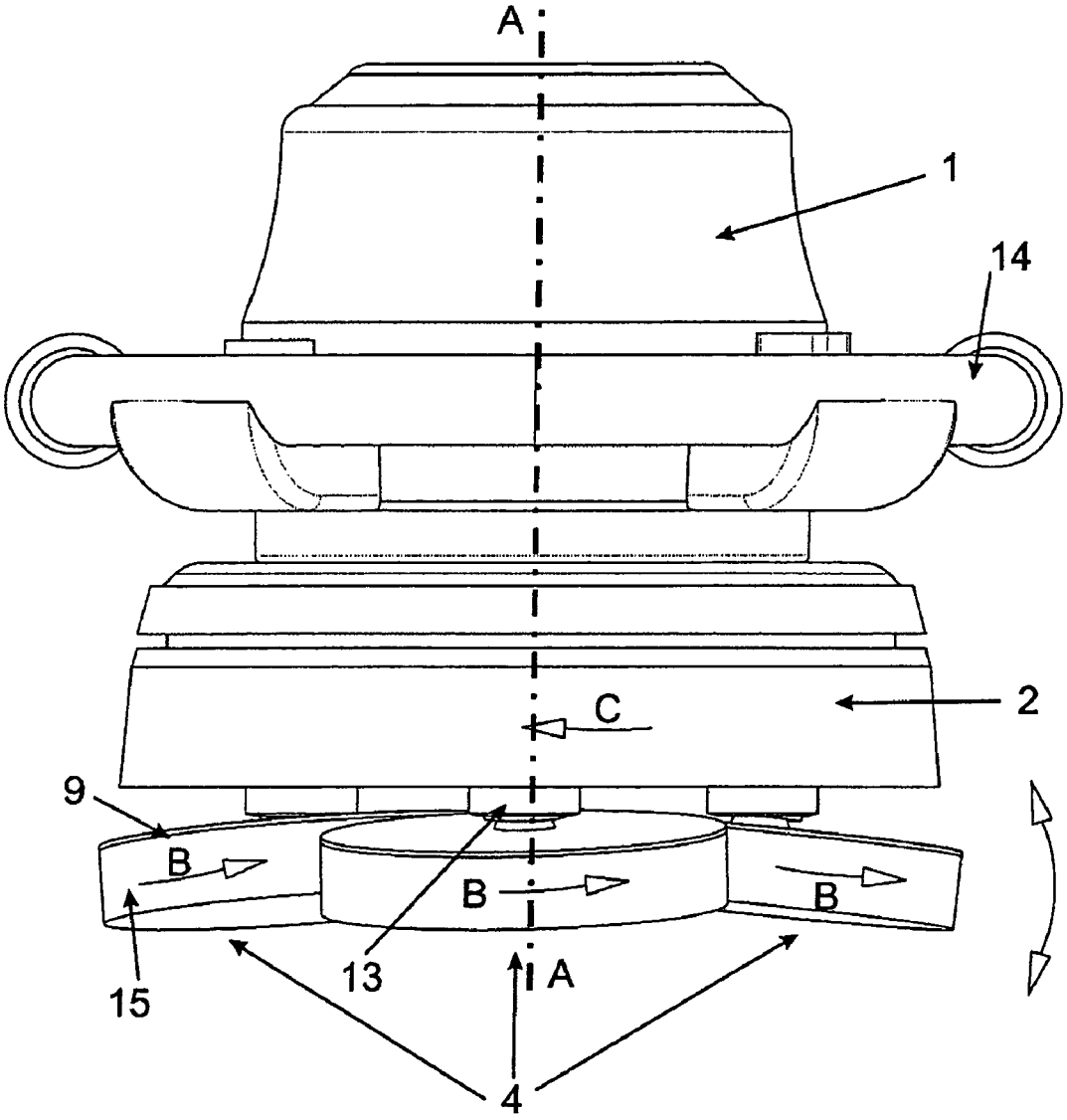
FIG. 1 a front view of a device for the machining of surfaces by the example of a grinding respectively polishing machine with 3 rotating and swivel mounted tool holding fixtures, FIG. 2 a perspective view of the device of FIG. 1 seen from below, FIG. 3 a sectional view of the device of FIG. 1 cut along the line A—A, FIG. 4 a partially cut perspective view of the device of FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, not should be inferred to the limit of the subject matter disclosed herein.

All patents referred to herein, are hereby incorporated herein by reference, whether or not specifically to do so within the text of this disclosure.

In the present disclosure, the words "a" or "an" are to be taken to include both the singular and the plural. Conversely, any reference to plural items shall, where appropriate, include the singular.

Figure 2:
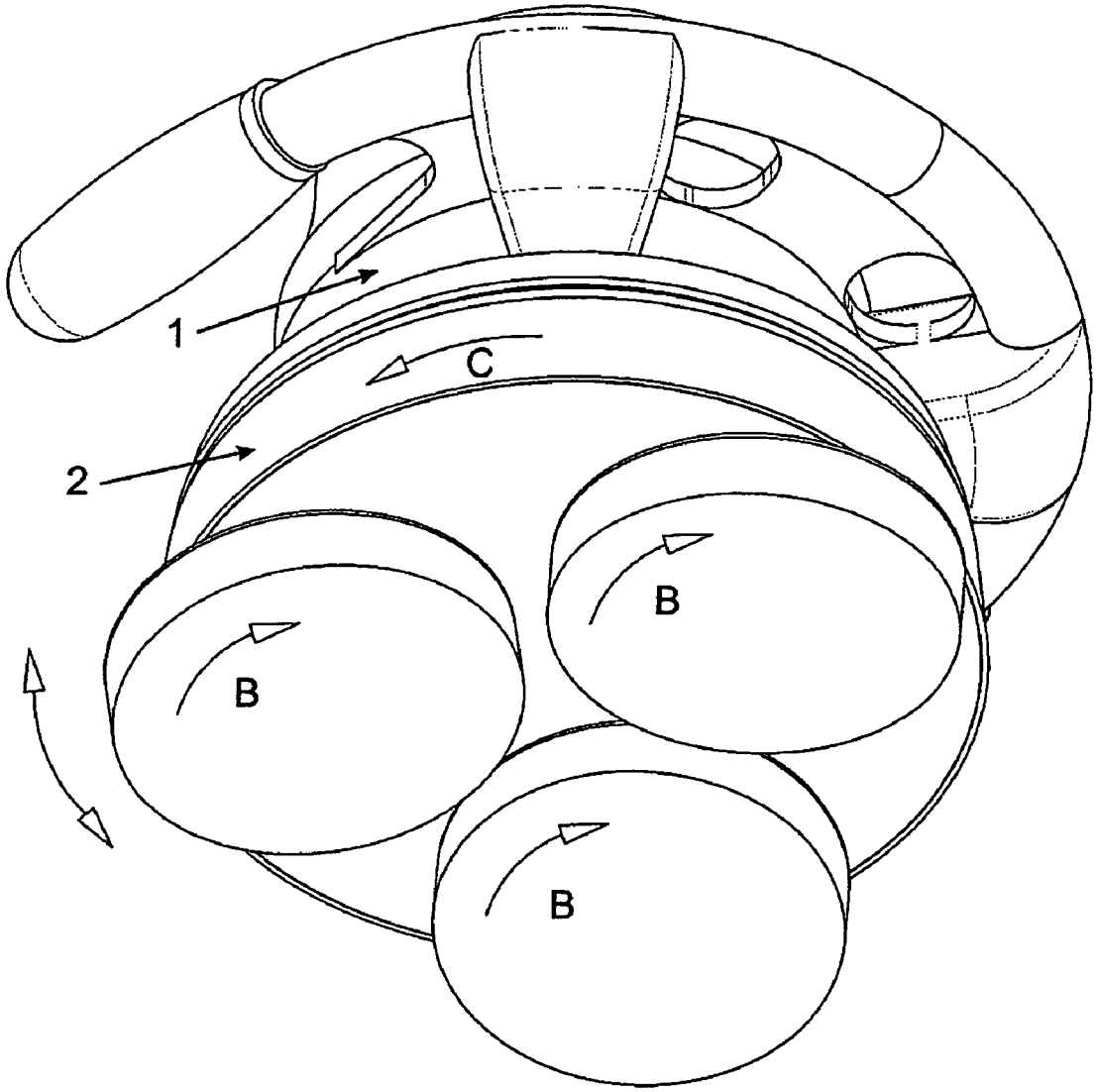
Figure 3:
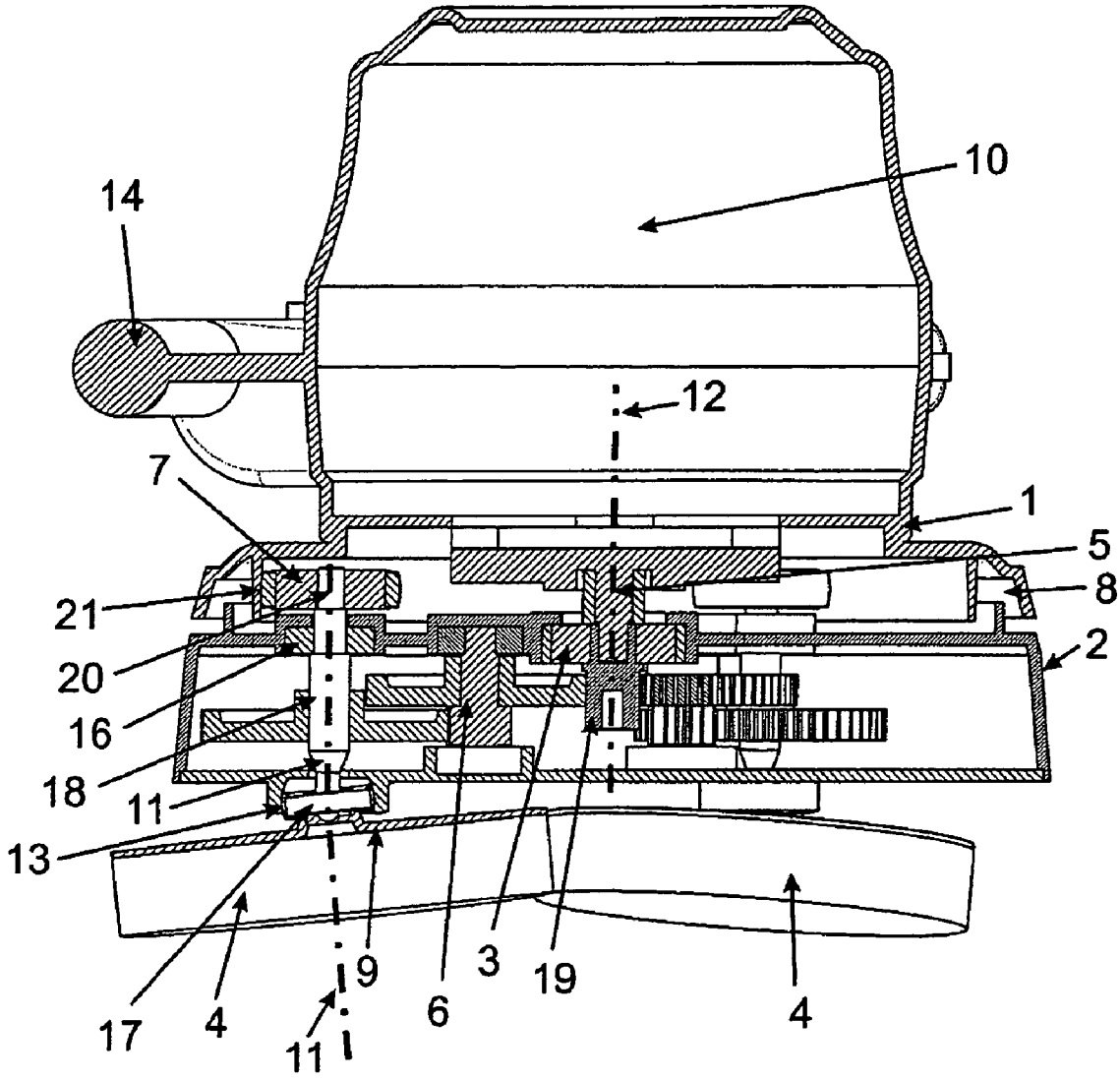
Figure 4:
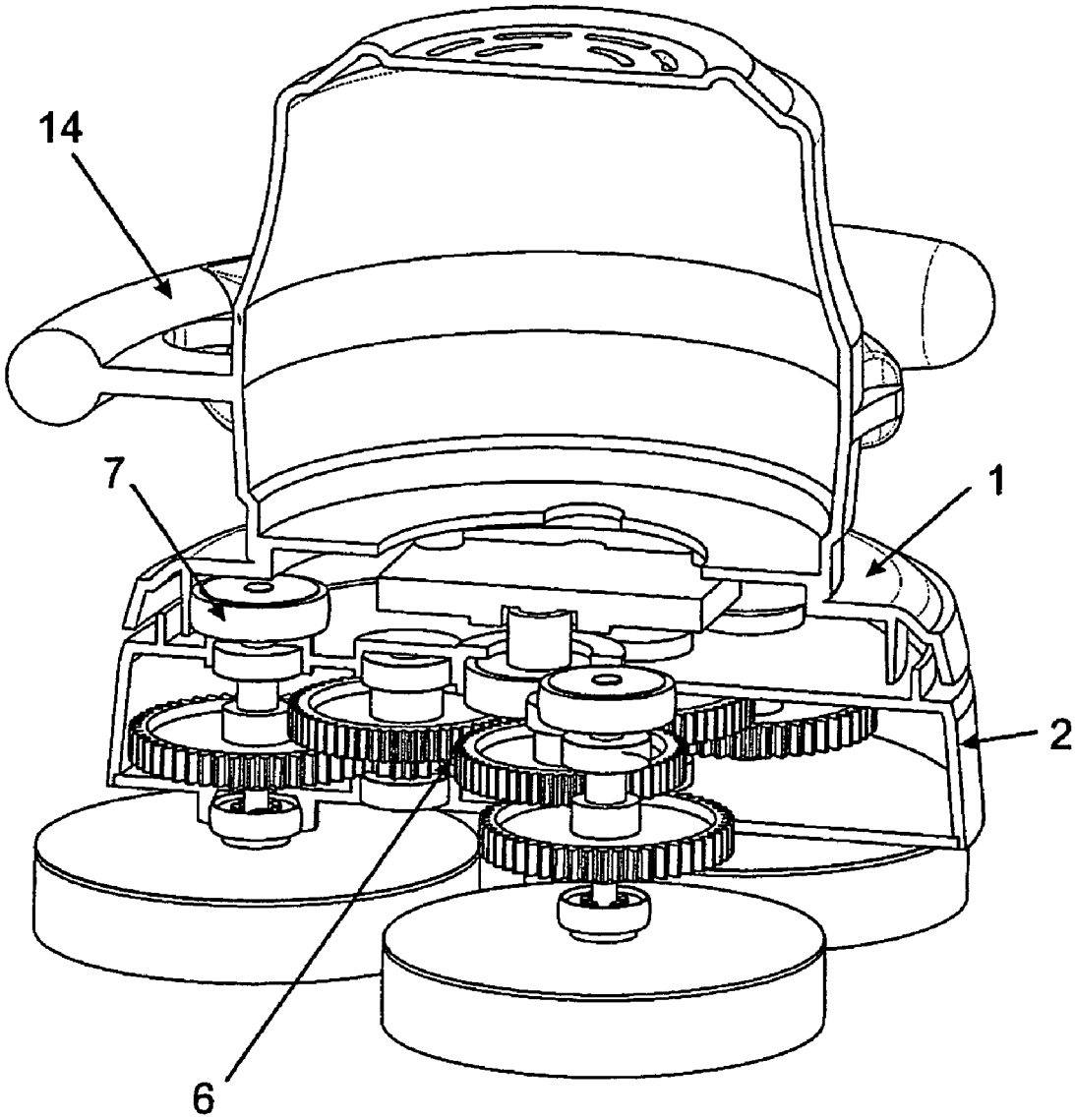

The device according to the invention for the machining of surfaces is described by the example of a grinding respectively polishing machine shown in the FIGS. 1 to 4 with 3 rotating and individually swivel mounted tool holding fixtures similar to the grinding machine described already above in accordance with DE 44 47 162 A. For the purposes of disclosing an exemplary design of a drive unit and a swivel bearing of the individual tool holding fixtures in a housing of such a grinding and/or polishing machine hereby the whole disclosed content of this paper is included by reference.

The device according to the invention possesses a housing, which comprises a first, in the example upper, housing unit 1 and a second, in the example lower, housing unit 2. The device is to be held at the first housing unit 1 during its use by an operator. For this a handle 14 or a particularly shape of the housing designed for this purpose can be intended. Three tools 4 with tool holding fixtures 9 and grinding respectively polishing means 15, which are removable attached to said tool holding fixtures e.g. through gluing, Velcro, micro replications or a clamping setting, are mounted in the example in the second housing unit 2 rotatable and preferably all-around swiveling in suitable holders 13 at the bottom. The number of used tool holding fixtures 9 is actually arbitrary, so that in extreme cases also one individual tool holding fixture or two respectively more than three holders are possible. The holders must be rotatable mounted at least around a rotating axis 11 serving as work axis—the simultaneous ability to swivel of the rotational axis is for the machining of curved surfaces a benefit, but not necessarily necessary. The rotation of the individual tool holding fixtures is suggested in FIGS. 1 and 2 by arrows B. Furthermore also an eccentric rotary motion of the individual tool holding fixtures is generally possible.

The first and the second housing unit 1 and 2 are joined with one another relatively concentrically rotatable to each other through a bearing 3, which will later described in more detail, so that by holding the first housing unit 1 a rotation of the second housing unit 2 is possible. The arrow C in FIGS. 1 and 2 suggests this rotary motion. Driving means to drive the tool holding fixtures 9 and to drive the second housing unit 2 for rotation relative to the first housing unit 1 are intended in the housing of the device in order to create the rotary motions. A gasket setting is intended between the two housing units 1 and 2, which, as for example shown diagrammatically in FIGS. 3 and 4, can be designed as a diaphragm gland respectively labyrinth seal 8 of interlinking projections shaped at the outer circumference of the two units 1 and 2. Alternatively or additionally a gasket component or an airflow gasket can be intended. Thereby the airflow can be taken in at a part of the housing by a cooling fan of a drive motor and be discharged through the gap between the housing units 1 and 2, in order to prevent the penetration of dust between the housing units.

The driving means to drive the tool holding fixtures 9 and to drive the second housing unit 2 for rotation relative to the first housing unit 1 comprise preferably a joint electrical, pneumatic or hydraulic rotary power source 10 in form of a motor. This motor can be arranged as represented in the first housing unit 1 or alternatively also in the second housing unit 2. The output drive moment of the motor 10 is transferred by the driven shaft 5 of the motor 10 to the turning shafts 18 of the individual tool holding fixtures 9 to a set of gears 9 contained in the second housing unit 2 and which can be recognized well in FIGS. 3 and 4. In the example shown the turning shafts 18 of the tool holding fixtures 9 are mounted with bearings 16 and 17 in the second housing unit 2 rotatable around rotational axes 11. The bearing 17 is located in addition in a holder 13, which is held tiltable in the lower housing side of the second housing unit 2, said holder 13 in return being attached to the tool holding fixture 9. Thus tilting of the tool holding fixture 9 and therefore the rotational axis 11 outside of the device is possible.

As previously mentioned, the second housing unit 2 is in such a way joined with the first housing unit 1 that a relative rotation C between these two units is possible. In the example a bearing, for example a radial antifriction bearing or a friction bearing 3, is connected on the one hand with the driven shaft 5 of the motor 10 and on the other hand with the second housing unit 2. The connection can be made as represented by a reduction sleeve 19, so that a coupling of the two housing units during assembly and a disconnection for maintenance are very simple. The second housing unit 2 is thereby mounted at the motor shaft 5 and concentrically rotatable to it. Alternatively the second housing unit 2 can also be joined with the first housing unit 1 through a bearing, its interior and outer rings in each case attached to the housing units themselves.

In the example three drive components in the form of friction wheels 7 are located in the area between the housing units 1 and 2, which are joined in each case secured against torsion with the end sections 20 of the drive shafts 18, emerging from the second housing unit 2, of the individual tool holding fixtures. A torque is transferred from the drive shafts 18 to the first housing unit 1 through the friction wheels 7, which rest frictionally engaged against an interior periphery area 21 of a flange attached to the bottom of the first housing unit 1, and, if the first housing unit 1 is held, the second housing unit 2 is shifted into rotation relative to the first housing unit. The three friction wheels 7 located in a symmetrical distance around the center according to the tool holding fixtures support furthermore the first housing unit 1 in the external area in relation to the second housing unit 2, in order to prevent a tilting of the housing units to each other and to guarantee the coaxial rotation. For the purpose of an improved support additional axial supporting means like a circulating stop or a groove for the friction wheels at the flange, sliding surfaces or supporting rollers in the external area could be intended.

By attaching the friction wheels 7 at the end sections 20 of the drive shafts 18, which are compared to the tool holding fixtures 9 located at opposite sides of the drive shafts, it is achieved that the rotation of the first housing unit (1) relative to the second housing unit (2) is regarding the direction of rotation C opposed to the direction of rotation B of the rotation of the individual tool holding fixtures 9. Thus the torques of these two rotary motions compensate each other to a large extent. Alternatively to the shown frictionally engaged coupling of the drive components for the transmission of the torque for the rotation of the housing units 1 and 2 also an interlocking coupling in form of a gearwheel and a matching gear cutting e.g. at the interior periphery area 21 of the flange can be intended.

In accordance with a not represented design example in each case individual sources of rotary drives can be intended for the rotation of the first and second housing units relatively to each other and the rotation of the individual tool holding fixtures, which are contained in the respective housing units. Here only the supply of the energy (electric current, hydraulic or pneumatics fluid media) through the rotational axis between the housing units would have to be guided. With this variation depending upon rating of the power sources it is possible to do without a set of gears if necessary, if this is not required for the distribution of one drive moment to several tool holding fixtures.

From the foregoing it will be observed that the numerous modifications and variations can be effectuated without departing from the true spirit and scope of the novel concepts of the present inventions. It is to be understood that no limitation with respect to the specific embodiments illustrated is intended or should be inferred. The disclosure is intended to cover by the appended claims all such modifications as fall within the scope of the claims.

What is claimed is:

1. A motor driven handheld tool for the machining of surfaces, comprising:

a first housing unit for supporting said motor driven handheld tool;

a second housing unit joined to said first housing unit, said first and second housing units being rotatable relative to each other;

at least one tool holding fixture that is rotatably mounted in said second housing unit and that is adapted to receive a tool therein to allow a surface to be machined;

a means for driving said at least one tool holding fixture and for driving the second housing unit for rotation relative to the first housing unit;

wherein said driving means comprises a joint rotary power source that drives said at least one tool holding fixture at the same time as it causes relative rotation between said first and second housing units; and wherein said driving means further comprises a drive component joined in each case secured against rotation with the end section of a drive shaft of said at least one tool holding fixture at the opposite side thereof and frictionally or interlockingly coupled with the first housing unit for transferring torque to said first housing unit for the rotation of the same relative to said second housing unit.

2. The motor driven handheld tool for the machining of surfaces in accordance with claim 1, wherein said first and second housing units are joined with one another through a bearing for concentric rotation.

3. The motor driven handheld tool for the machining of surfaces in accordance with claim 2, wherein a gasket setting is intended between the first and the second housing unit.

4. The motor driven handheld tool for the machining of surfaces in accordance with claim 2, wherein said bearing, through which the first and second housing unit are joint rotatable relatively to each other, is arranged on a driven shaft of a rotary power source.

5. The motor driven handheld tool for the machining of surfaces in accordance with claim 2, wherein said bearing, through which the first and second housing are joined rotatable relatively to each other, is arranged on a driven shaft of a rotary power source that is contained in said first housing unit.

6. The motor driven handheld tool for the machining of surfaces in accordance with claim 1, wherein a gasket setting is inserted between the first and the second housing unit.

7. The motor driven handheld tool for the machining of surfaces in accordance with claim 1, wherein said gasket setting is selected from the group consisting of a diaphragm gland, a labyrinth seal, a gasket component, and an airflow gasket.

8. The motor driven handheld tool for the machining of surfaces in accordance with claim 1, wherein first, second, and third tool holding fixtures are mounted in said second housing unit, and wherein each one of said first, second, and third tool holding fixtures are rotatable around their own axis in said second housing unit.

9. The motor driven handheld tool for the machining of surfaces in accordance with claim 1, wherein said driving means is selected from the group consisting of an electrical, pneumatic and hydraulic rotary power source.

10. The motor driven handheld tool for the machining of surfaces in accordance with claim 1, wherein said driving means further comprises a gear and shaft assembly that transmits torque from said shaft to said at least one tool holding fixture.

11. The motor driven handheld tool for the machining of surfaces in accordance with claim 10, wherein said gear and shaft assembly is contained in said second housing unit.

12. The motor driven handheld tool for the machining of surfaces in accordance with claim 1, wherein the relative rotation between said first and second housing units is opposite to the rotation of said at least one tool holding fixture.

13. The motor driven handheld tool for the machining of surfaces in accordance with claim 1, wherein said drive component is frictionally or interlockingly coupled with an interior periphery of the first housing unit.

* * * * *